United States Patent [19]

Hansen

[11] Patent Number: 4,459,337

[45] Date of Patent: Jul. 10, 1984

[54] COATED POLYAMIDE MONOFILAMENT

[75] Inventor: John E. Hansen, Wilmington, Del.

[73] Assignee: E. I. Du Pont de Nemours and Company, Wilmington, Del.

[21] Appl. No.: 449,498

[22] Filed: Dec. 13, 1982

Related U.S. Application Data

[63] Continuation-in-part of Ser. No. 383,455, Jun. 1, 1982, abandoned.

[51] Int. Cl.[3] ..... D02G 3/00

[52] U.S. Cl. ..... 428/395; 15/167 R; 43/44.98; 428/401

[58] Field of Search ..... 428/375, 395, 373, 401; 15/167 R; 43/44.98

[56] References Cited

U.S. PATENT DOCUMENTS

| | | | |
|---|---|---|---|
| 2,748,525 | 6/1956 | Volz | 43/44.98 |
| 3,043,045 | 7/1962 | Martuch | 521/75 X |
| 3,295,156 | 1/1967 | Brant | 15/167 R |
| 3,486,266 | 12/1969 | Richardson et al. | 43/44.98 |
| 3,512,294 | 5/1970 | Howald | 43/44.98 |
| 3,523,034 | 8/1970 | Howald | 428/389 |
| 3,758,979 | 9/1973 | Martuch et al. | 43/44.98 |
| 3,830,009 | 8/1974 | Collingbourne | 43/44.98 |
| 3,841,015 | 10/1974 | Gregory | 43/44.98 |
| 4,048,744 | 9/1977 | Chandler | 43/44.98 |

FOREIGN PATENT DOCUMENTS 53-81717 7/1978 Japan .

*Primary Examiner*—Lorraine T. Kendell

[57] ABSTRACT

Oriented polyamide monofilament exhibiting improved wet-state performance characteristics through the use of a surface coating having 2 to 10 weight percent of a copolymer of vinylidene chloride and at least one ethylenically unsaturated monomer copolymerizable therewith.

10 Claims, 2 Drawing Figures

COATED POLYAMIDE MONOFILAMENT

CROSS-REFERENCE TO RELATED APPLICATION

This is a continuation-in-part of application Ser. No. 383,455, filed June 1, 1982, now abandoned.

BACKGROUND OF THE INVENTION

Nylon monofilament has been long used in a variety of applications. In recent years it has found increased acceptance as a fishing line, as technology has improved its characteristics. A combination of high tensile strength, good elongation and stiffness in such monofilamentary materials can be provided by controlling quenching and drawing conditions for the monofilament, as described in U.S. Pat. No. 3,156,750. Improvement in filament knot strength has been provided by steam conditioning as described in U.S. Pat. No. 3,595,952.

Previously available nylon fish line has exhibited a marked change in properties with the absorption of water. For example, over a normal fishing exposure of 6 hours, polyamide fish line typically loses more than half of its original stiffness. This change in stiffness with exposure to water requires the user to alter his casting technique to maintain accuracy with continued use of the line. Accordingly, a need exists for a polyamide fish line that maintains uniform performance characteristics even with long exposure to water.

SUMMARY OF THE INVENTION

The present invention provides oriented polyamide monofilament having outstanding performance characteristics which are retained after extended exposure to water.

Specifically, the present invention provides an oriented polyamide monofilament uniformly coated with about 2–10 percent, by weight of the monofilament, of a copolymer of vinylidene chloride and at least one ethylenically unsaturated monomer, the copolymer containing at least about 75% by weight of vinylidene chloride.

BRIEF DESCRIPTION OF THE FIGURES

The Figures are graphical representations of the effect of water immersion on the physical properties of the coated monofilament of the present invention.

DETAILED DESCRIPTION OF THE INVENTION

Figure 1:
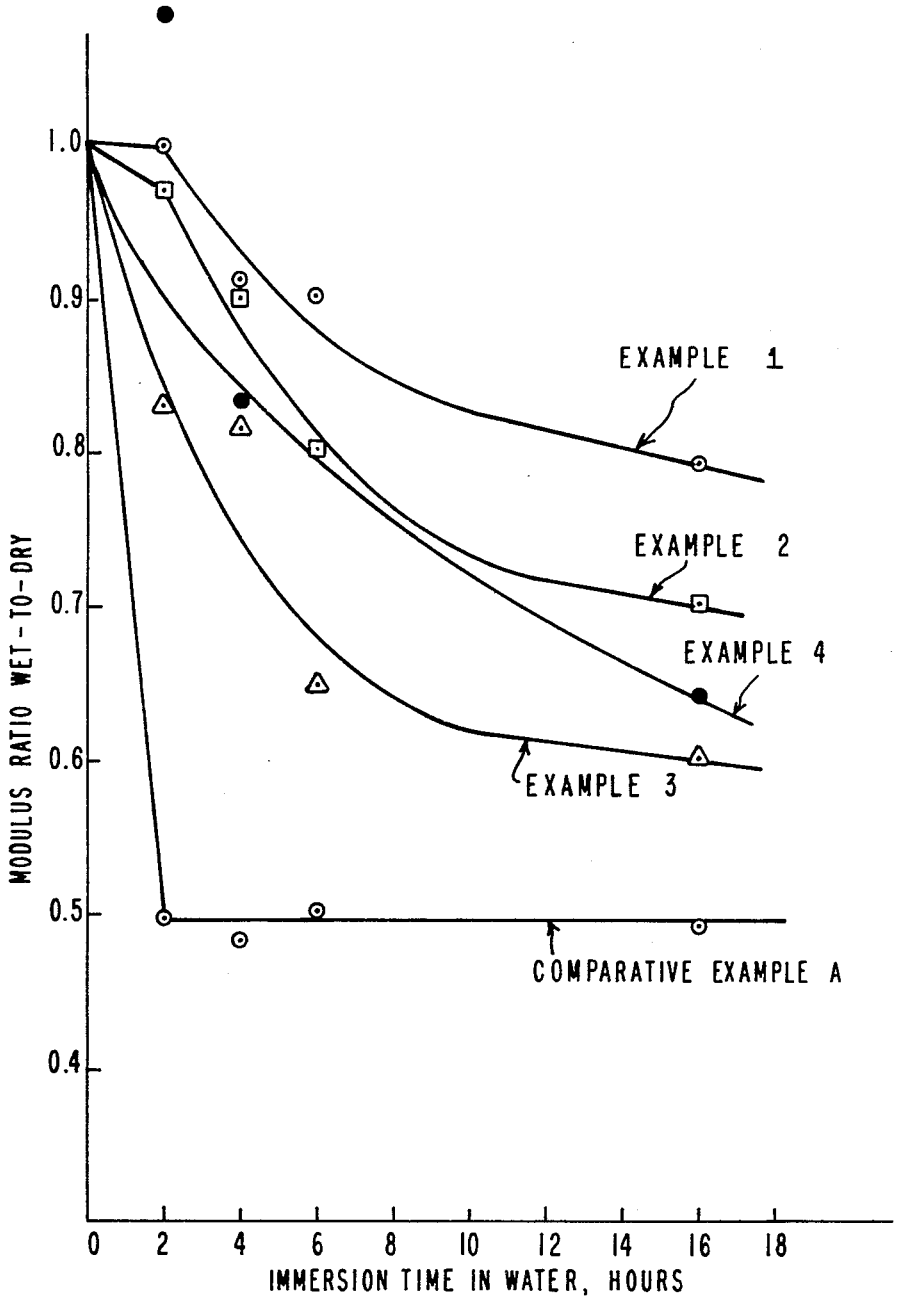

Polyamides useful for preparation of oriented monofilaments of the present invention are non-cyclic polyamides of fiber-forming molecular weight having a relative viscosity generally between 25 and 100 as determined by ASTM D789-62T. These include, for example, polycaprolactam (6 nylon), polyhexamethylene adipamide (66 nylon) polyhexamethylene decanoamide (610 nylon), and polyhexamethylene dodecanoamide (612 nylon). Polyamide copolymers can also be used, such as the copolymer of 6 nylon and 66 nylon. For the production of filaments particularly well suited for fishing line, polycaprolactam (6 nylon) is preferred. The polyamides can be produced using techniques well known to the art, by condensation of equimolar amounts of saturated dicarboxylic acid containing from 4 to 12 carbon atoms with a diamine containing from 4 to 14 carbon atoms. 6 nylon is regularly prepared by the condensation polymerization of caprolactam.

The monofilament material is spun from the polymer blend according to customary techniques, followed by stretch orientation from $4\frac{1}{2}$ to 6 times the original length of the spun monofilament. A particularly satisfactory orientation technique is that two stage drawing process described in Cuculo, U.S. Pat. No. 3,156,750. After orientation, the monofilament can be further treated to improve other physical properties thereof, as by steam conditioning described in Boyer et al. U.S. Pat. No. 3,595,952.

In accordance with the instant invention, an oriented polyamide monofilament is coated with a copolymer of vinylidene chloride and at least one ethylenically unsaturated monomer copolymerizable therewith. A wide variety of comonomers can be used in conjunction with vinylidene chloride, including for example, acrylonitrile, methyl acrylate, methacrylonitrile, ethyl acrylate, propyl acrylate, butyl acrylate, isobutyl acrylate, methyl methacrylate, ethyl methacrylate, butyl methacrylate, isobutyl methacrylate, methyl vinyl ketone, vinyl chloride, vinyl acetate, styrene, dichloro vindylidene fluoride, chloroprene, butadiene and methoxymethoxyethyl methacrylate. In addition, an unsaturated organic acid such as itaconic acid or acrylic acid can be copolymerized with the vinylidene chloride and the copolymerizable ethylenically unsaturated monomer to create a three component system. Other copolymers which can be used in the present invention include vinylidene chloride/dimethyl itaconate, vinylidene chloride/diethyl itaconate, vinylidene chloride/dibutyl itaconate, vinylidene chloride/vinyl pyridine and vinylidene chloride/isoprene. A particularly preferred vinylidene chloride copolymer is that prepared from vinylidene chloride, methyl methacrylate and itaconic acid, especially in a monomer ratio of about 90.5/8.5/1.0 weight percent.

The vinylidene chloride copolymers are conveniently applied to the surface of the monofilament in the form of an emulsion. Aqueous emulsions have been found to be particularly convenient for the vinylidene chloride copolymers used in the present invention, and should have a solids content of at least about 15% by weight. Aqueous emulsions having a solids content in excess of about 40% are difficult to use in coating applications, and concentrations of about from 20–25 percent solids have been found to particularly satisfactory. Preferably, the aqueous emulsion of vinylidene chloride copolymer further comprises about 1–5 percent of a hard wax added in the form of a wax emulsion and containing about 15–30% by weight of wax. A wide variety of hard waxes can be used, of which carnauba wax and the distearamide of ethyl diamine are particularly preferred. An emulsion of carnauba wax is commercially available from Morton Chemical Company as "Serfine" DL-96 and an emulsion of a distearamide of ethylene diamine is commercially available from Glyco, Incorporated as Acrawax "C".

To improve the surface uniformity of the vinylidene chloride copolymer coating and to optimize the stiffness of the monofilament, the polyamide monofilament is preferably washed in a water bath to remove surface impurities. The temperature of the water bath is typically maintained at about 85°–100° C. Immersion times can vary widely, but will typically be about 1–15 seconds.

Adhesion of the vinylidene chloride copolymer to the monofilament is improved by the application of a primer. A wide variety of primers can be used, including those commercially available, to improve the adhesion of the coating to polyamides. One primer found to be particularly satisfactory for the present invention is a polyvinylidene chloride primer composition commercially available from the Morton Chemical Company as "Serfine" 2012 primer. This primer, applied at a concentration of about 5% by weight solids, gives significantly improved adhesion of the vinylidene chloride copolymer coating. The primer can be conveniently applied by a dip coating technique, after which the primer is dried in any conventional heating means.

Vinylidene chloride copolymer is conveniently applied to the polyamide monofilament as an emulsion or solution. However, to avoid elaborate procedures for solvent recovery, aqueous emulsions are particularly preferred. The emulsion can contain about 10–50 weight percent solids, and a co-polymer concentration in the emulsion of about 20–25% by weight has been found to give particularly satisfactory coatings.

Vinylidene chloride co-polymer can be applied to the surface of the filament in the same general manner as the primer, that is, by dip coating using appropriate means to control the thickness of the applied coating, such as grooved rolls, gravure rolls or wiping. In general, the benefits of the present invention are realized with the use of about 2–10 weight percent vinylidene chloride co-polymer as a final coating weight based on the weight of the monofilament. Particularly good results are obtained using about 4–6 weight percent.

After application of the aqueous emulsion of vinylidene chloride co-polymer, the coating is dried using any convenient means such as radiant or hot air heaters. Radiant heating and hot forced air have been found to be particularly satisfactory for the present invention, providing a preferred temperature gradient of about 25°–225° C.

The coated monofilaments of the present invention provide excellent performance in applications involving extended exposure to water or high moisture environments. The performance characteristics remain substantially constant after extended exposure to water. After exposure to room temperature water for 6 hours, the wet-to-dry tensile modulus ratio exhibited by the present coated monofilaments is generally greater than about 0.7 and the wet-dry tensile strength ratio of the coated monofilaments is generally greater than about 0.9. Even after 16 hours' exposure, the wet-to-dry tensile modulus ratio of the present monofilament is at least about 0.6, while untreated fishline dropped to a ratio of 0.5 after only two hours' exposure. In addition, the knot strength of the coated monofilaments is surprisingly high. Thus, the present coated monofilaments are useful in a wide variety of applications which involve exposure to water, such as tooth brush filaments and fishing line. Monofilament useful as a fishline will generally have a diameter of about from 0.102 to 1.270 mm, while toothbrush filaments will generally have a diameter of about from 0.152 to 0.356 mm. Use of the monofilaments as tooth brush filaments provides particularly desirable advantages, in that the short filament lengths, on exposure to water, develops a unique stiffness profile that provides an excellent combination of comfort and cleaning capability.

The present invention is further illustrated by the following specific examples, in which parts and percentages are by weight unless otherwise indicated. In these examples, the monofilaments were prepared from unextracted 6 nylon which was oriented by drawing 5.3 times its original length in two stages as described in Example 1 of Keller, U.S. Pat. No. 3,063,189, and then steam treated as described in Boyer and Hansen, U.S. Pat. No. 3,595,952.

EXAMPLES 1 AND 2

In each of Examples 1 and 2, oriented nylon monofilament having a diameter of about 0.432 mm and 0.330 mm, respectively, was passed through a water bath maintained at 100° C. for a residence time of 8.3 seconds and maintained at a tension of 450 g. Primer was applied to the monofilament by passing it over two wheels rotating at 7 and 17 rpm for the first and second wheel, respectively. Each wheel had a diameter of 102 mm and the line speed was 30.5 meters per minute. The rims of the wheels were immersed in an aqueous solution of "Serfine" 2012 primer commercially available from Morton Chemical Company. This solution contained 5 wt. % solids. The resulting primed monofilament was then passed through a radiant heater to dry the primer solution. The radiant heater had a temperature profile of about 115°–230° C. and the line speed was adjusted to provide a residence time of about 3 seconds.

The primed monofilament was then passed through a coating bath over a two wheel applicator system of the same type as was used for applying the primer. The coating bath was an aqueous co-polymer emulsion having a solids concentration of 22 wt.% co-polymer and about 1.5% sodium lauryl sulfate dispersing agent. The co-polymer was prepared from vinylidene chloride, methyl methacrylate and itaconic acid in a monomer ratio of 90.5/8.5/1.0. The coating bath also contained about 2%, by weight of the solids in the coating bath, of carnauba wax. The wax was added as an aqueous dispersion commercially available from Morton Chemical Company as "Serfine" DL-96. After application of the co-polymer dispersion, the coated monofilament is dried using the same type of radiant heater as used for drying the primer coating and with a residence time in the heater of about 3 seconds.

The resulting monofilaments were evaluated for tensile modulus, tensile strength and elongation at break as described in Boyer and Hansen, U.S. Pat. No. 3,595,952. The testing was carried out after initial conditioning for at least 48 hours at 50% relative humidity and 73° F. and then after 2, 4, 6 and 16 hours in water. The monofilaments, after exposure to water, were tested immediately after removal from the water. The results are summarized Table I.

TABLE I

| Example | Immersion Time (hrs) | Tensile Modulus (MPa) | Tensile Strength (MPa) | % Elongation at Break | % Elongation at ⅛ break load |
|---|---|---|---|---|---|
| 1 | 0 | 1182 | 629 | 27.0 | 10.6 |
| | 2 | 1179 | 618 | 31.9 | 11.4 |
| | 4 | 1071 | 680 | 36.2 | 11.7 |
| | 6 | 1066 | 651 | 33.4 | 11.1 |
| | 16 | 937 | 649 | 33.3 | 12.1 |
| 2 | 0 | 1330 | 691 | 33.1 | 10.6 |
| | 2 | 1293 | 653 | 31.2 | 10.5 |
| | 4 | 1198 | 669 | 33.2 | 10.5 |
| | 6 | 1068 | 636 | 34.1 | 10.2 |
| | 16 | 933 | 617 | 34.9 | 10.7 |

EXAMPLES 3 AND 4 AND COMPARATIVE EXAMPLE A

In examples 3 and 4, additional samples of the coated monofilament were tested after about seven months' storage at ambient conditions. The test procedures of Examples 1 and 2 were repeated, and, in addition, the samples were evaluated for knot strength.

In Comparative Example A, the same test procedure was carried out on an oriented, polyamide fish line having a diameter of about 0.330 mm that had not been primed and coated as in Examples 1–4.

TABLE II

| Example | Immersion Time (hrs) | Tensile Modulus (MPa) | Tensile Strength (MPa) | % Elongation at Break | % Elongation at ⅓ break load | Knot Strength (MPa) |
|---|---|---|---|---|---|---|
| 3 | 0 | 1205 | 631 | 33.2 | 11.5 | 529 |
| | 2 | 995 | 607 | 31.6 | 10.5 | 517 |
| | 4 | 983 | 623 | 29.5 | 11.7 | 537 |
| | 6 | 782 | 573 | 31.4 | 11.0 | 472 |
| | 16 | 722 | 551 | 33.2 | 11.7 | 420 |
| 4 | 0 | 1487 | 651 | 31.2 | 9.8 | 556 |
| | 2 | 1613 | 682 | 28.6 | 8.9 | 572 |
| | 4 | 1238 | 618 | 29.2 | 10.4 | 573 |
| | 6 | 1194 | 642 | 34.2 | 10.4 | 547 |
| | 16 | 956 | 579 | 30.5 | 10.5 | 554 |
| A | 0 | 1421 | 669 | 33.4 | 11.6 | 623 |
| | 2 | 705 | 555 | 30.9 | 10.4 | 504 |
| | 4 | 684 | 548 | 34.5 | 12.6 | 514 |
| | 6 | 721 | 527 | 29.1 | 11.5 | 499 |
| | 16 | 702 | 535 | 33.4 | 12.1 | 513 |

Figure 2:
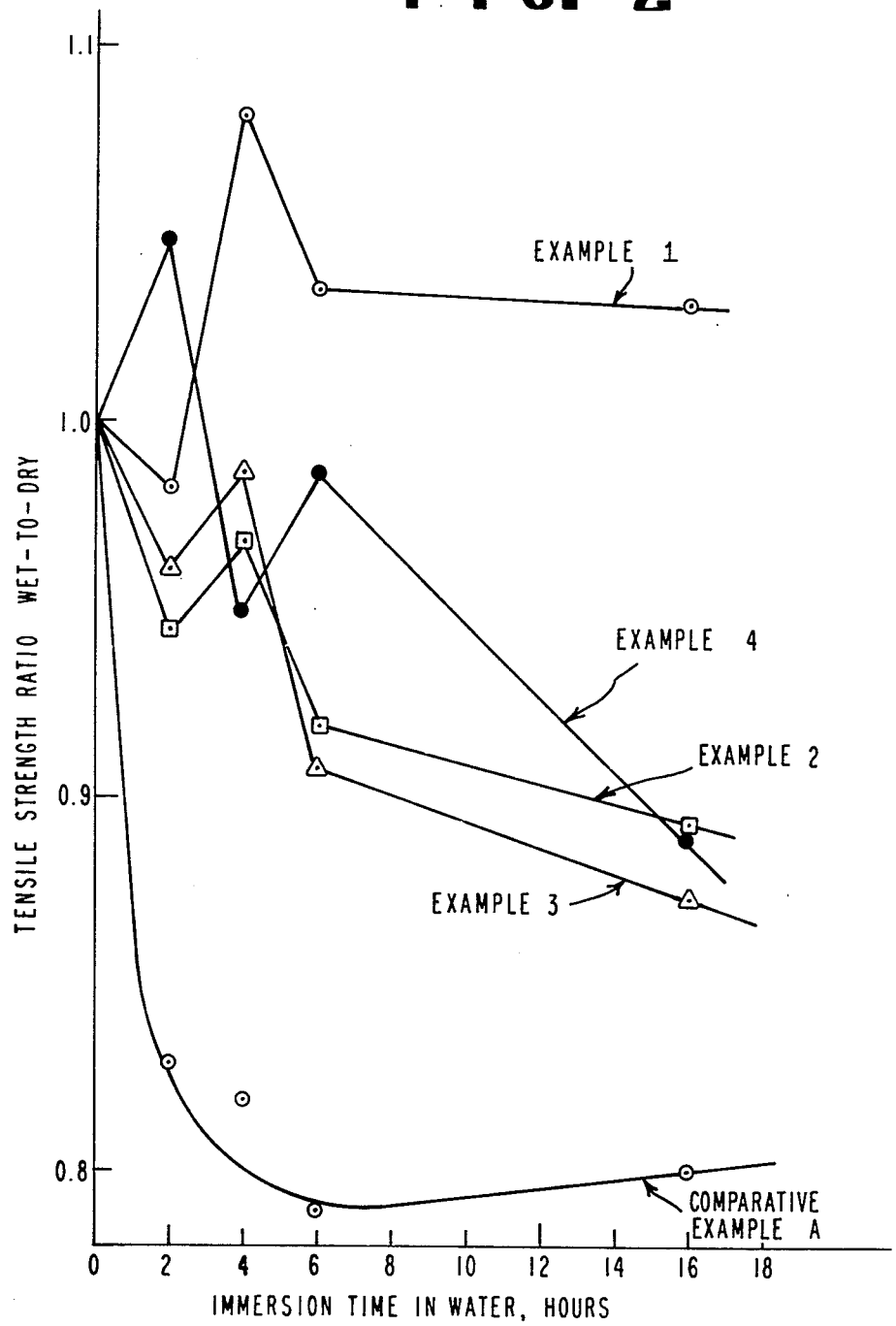

The ratios of tensile modulus and tensile strength of the monofilament samples as originally conditioned at 50% relative humidity and after immersion in water for several hours were calculated and are graphically represented in FIGS. 1 and 2.

As can be seen from FIG. 1, the present monofilaments, even after 16 hours immersion in water, exhibit a wet-to-dry tensile modulus ratio which is significantly higher than that of Comparative Example A, similar but untreated commercial polyamide fishline. In addition, the untreated fishline exhibits a marked drop in tensile modulus ratio after only two hours of immersion.

EXAMPLE 5

The general procedure of Example 2 was repeated, except that instead of a two wheel applicator system, the primer and coating bath were applied by passing the filament under a pin immersed in the coating liquid and then through two felt pads on which pressure was applied by means of steel bars. The monofilaments were tested as in Example 2 and the results are summarized in Table III.

TABLE III

| Example | Immersion Time (hrs) | Tensile Modulus (MPa) | Tensile Strength (MPa) | % Elongation at Break | % Elongation at ⅓ break load | Knot Strength (MPa) |
|---|---|---|---|---|---|---|
| 5 | 0 | 1439 | 636 | 30 | 10 | 407 |
| | 2 | 1468 | 671 | 30 | 9.3 | 478 |
| | 4 | 1429 | 650 | 31 | 9.4 | 439 |
| | 6 | 1436 | 676 | 31 | 9.3 | 471 |
| | 16 | 1399 | 634 | 28 | 9.2 | 457 |

I claim:

1. An oriented polyamide monofilament having uniformly coated thereon about 2–10 percent, by weight of the monofilament, of a copolymer of vinylidene chloride and at least one ethylenically unsaturated monomer copolymerizable therewith, the copolymer containing at least about 75% by weight of vinylidene chloride units.

2. A polyamide monofilament of claim 1 wherein the vinylidene chloride coating comprises about 4–6 weight percent.

3. A polyamide monofilament of claim 1 copolymer is a terpolymer of vinylidene chloride, methyl methacrylate and itaconic acid.

4. A polyamide monofilament of claim 3 wherein the terpolymer components are present in a monomer ratio of about 90.5/8.5/1.0.

5. A polyamide monofilament of claim 1 wherein the coating further comprises about 1–5 weight percent wax, based on the weight of solids.

6. A polyamide monofilament of claim 5 wherein the wax consists essentially of carnauba wax.

7. A polyamide monofilament of claim 1 wherein the polyamide is nylon 6.

8. A polyamide monofilament of claim 1 wherein the polyamide is nylon 66.

9. A polyamide monofilament of claim 1 useful as a fishline and having a diameter of about 0.102–1.270 mm.

10. A polyamide monofilament of claim 1 useful as a toothbrush bristle and having a diameter of about 0.152–0.356 mm.

* * * * *